US007338039B2

(12) United States Patent
Pfau et al.

(10) Patent No.: US 7,338,039 B2
(45) Date of Patent: Mar. 4, 2008

(54) SPRING SUSPENSION MAT

(76) Inventors: Karl-Heinz Pfau, Am Lehenwald 12, D-72275 Alpirsbach (DE); Edgar Franke, Waldstrasse 16, D-72275 Alpirsbach-Reutin (DE)

( * ) Notice: Subject to any disclaimer, the term of this patent is extended or adjusted under 35 U.S.C. 154(b) by 70 days.

(21) Appl. No.: 11/186,169

(22) Filed: Jul. 21, 2005

(65) Prior Publication Data

US 2005/0253318 A1 Nov. 17, 2005

Related U.S. Application Data

(63) Continuation-in-part of application No. 10/824,911, filed on Apr. 15, 2004, now abandoned, which is a continuation-in-part of application No. PCT/EP02/12299, filed on Nov. 4, 2002.

(30) Foreign Application Priority Data

May 15, 2002 (DE) ..... 202 07 605
May 12, 2003 (EP) ..... 03 010 551

(51) Int. Cl.
*A47C 23/00* (2006.01)

(52) U.S. Cl. ..... 267/144; 267/165

(58) Field of Classification Search ..... 267/142, 267/143, 144, 145, 146, 147, 130, 103, 86, 267/87, 160, 165
See application file for complete search history.

(56) References Cited

U.S. PATENT DOCUMENTS 5,747,140 A * 5/1998 Heerklotz ..... 428/131

FOREIGN PATENT DOCUMENTS

| | | |
|---|---|---|
| AU | 405 481 | 8/1999 |
| DE | 132171 | 4/1901 |
| DE | 317362 | 12/1919 |
| DE | 344247 | 11/1921 |
| DE | 357703 | 8/1922 |
| DE | 475144 | 4/1929 |
| DE | 650903 | 10/1937 |
| DE | 846158 | 8/1952 |
| DE | 883678 | 7/1953 |
| DE | 20471 | 12/1960 |
| DE | 1916968 U | 6/1965 |
| DE | 1975358 U | 12/1967 |
| DE | 2046445 | 3/1972 |
| DE | 2015659 | 10/1974 |
| DE | 2400092 | 7/1975 |
| DE | 7929543 U | 5/1980 |
| DE | 9200114 U | 6/1993 |
| DE | 19505028 | 9/1995 |
| DE | 19828254 | 7/2000 |
| DE | 19902464 | 8/2000 |
| DE | 10023466 | 11/2001 |

(Continued)

*Primary Examiner*—Melanie Torres
(74) *Attorney, Agent, or Firm*—Cantor Colburn LLP

(57) ABSTRACT

In a spring assembly, more especially for the cushioning of seats, beds or chairs or all types, including spring legs arranged in pairs, a bridge member extending between each spring leg of a pair of the spring legs, and a connecting member disposed between adjacent spring legs pairs to connect adjacent pairs. The spring leg pairs, bridge member and connecting member may be formed from a one-piece, continuous material, said material having a plurality of bends formed therein. The bends allow the spring leg pairs to fold independently of each other when the bridge member is subjected to a force.

20 Claims, 5 Drawing Sheets

FOREIGN PATENT DOCUMENTS

| | | |
|---|---|---|
| FR | 906.564 | 1/1946 |
| FR | 955.776 | 1/1950 |
| FR | 1.012.674 | 7/1952 |
| FR | 1.074.160 | 10/1954 |
| FR | 2759649 | 2/1997 |
| GB | 614133 | 12/1948 |
| GB | 614272 | 12/1948 |
| GB | 917563 | 2/1963 |
| GB | 934658 | 8/1963 |
| GB | 1042112 | 9/1966 |
| GB | 2055173 | 2/1981 |
| WO | WO 93/03652 | 3/1993 |
| WO | WO 96/39906 | 12/1996 |
| WO | WO 00/11989 | 3/2000 |

* cited by examiner

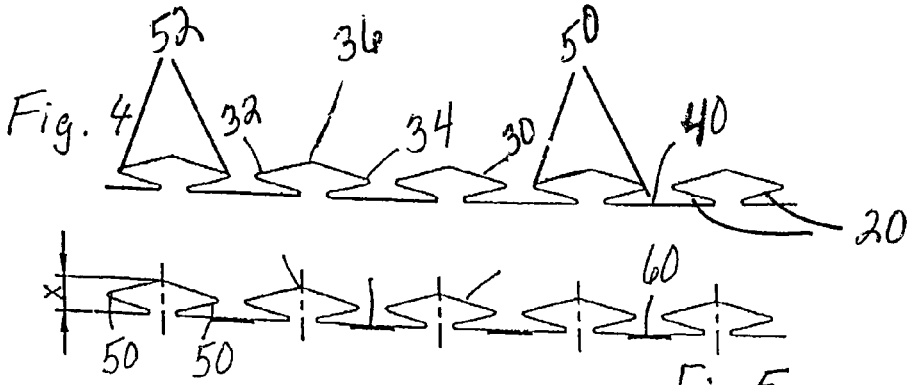
Fig. 4
Fig. 5
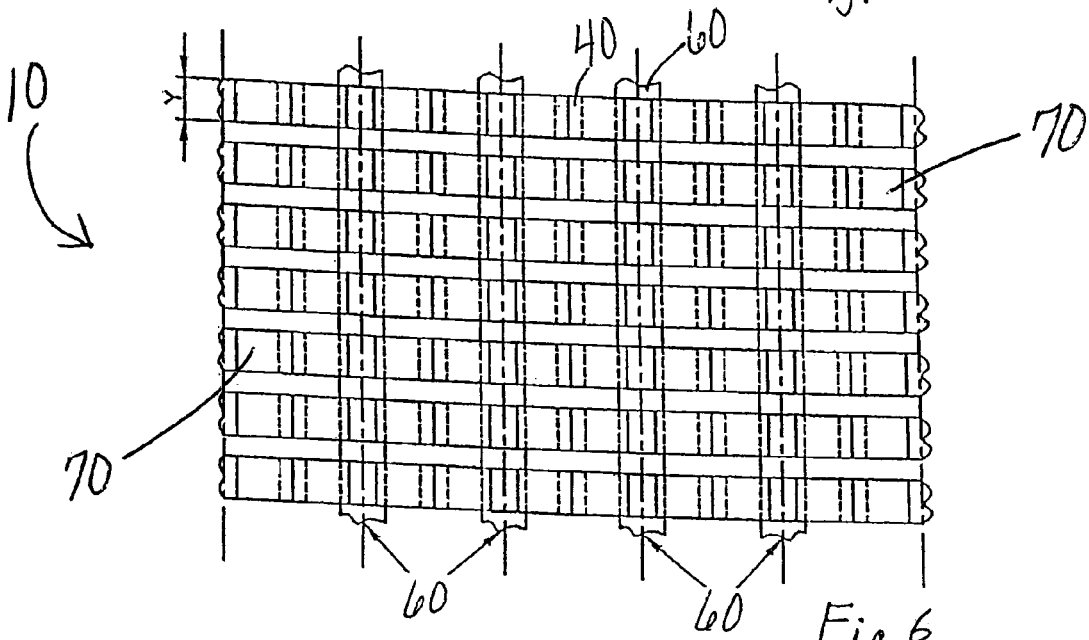
Fig. 6
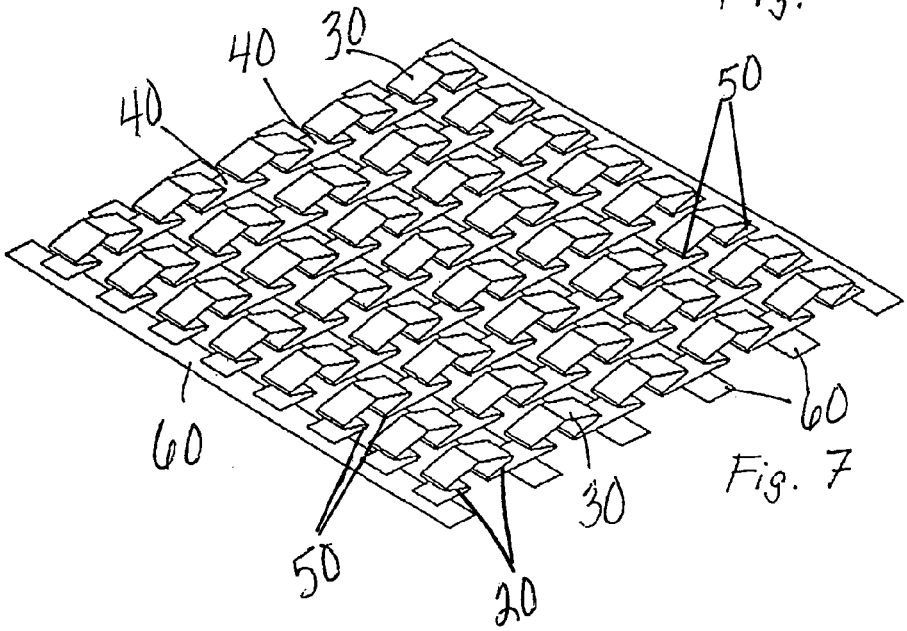
Fig. 7

SPRING SUSPENSION MAT

REFERENCE TO RELATED APPLICATIONS

This application is a continuation in part of U.S. patent application Ser. No. 10/824,911, filed Apr. 15, 2004 now abandoned, being a continuation in part of PCT application PCT/EP 02/12299, filed on Nov. 4, 2002, the entire contents of which are incorporated by reference herein. This application is also related to and claims the priority of German Utility Model 202 07 605.9, filed on May 15, 2002, the entire contents of which are incorporated by reference herein, and European Patent Application No. 03 010 551.4, the entire contents of which are incorporated by reference herein.

FIELD OF THE INVENTION

The invention relates to the cushioning of seats and the like, more particularly, to a spring assembly for a spring suspension mat.

PRIOR ART

FR 906 564 A makes known a spring base for seating which is a type of spring suspension mat in accordance with the main preamble of claim 1. Individual spring members are formed from spring-steel cross bands, one-piece spring parts being disposed with the spring members in such a manner that their height under load is reduced without influencing the remaining spring members. The spring members can be packed in plastics foam in the upholstery. On account of the bending radii of the spring members, the overall height nevertheless remains considerable, as the spring members 40 continuously require a minimum height, if plastic deforming of the connecting members 40 is to be avoided in favor of the durability of the spring action. The spring members themselves are suspended in a support frame parallel to each other.

DE 317 362 C makes known a spring base for seating according to the main preamble of claim 1. Individual spring members are formed separate from spring-steel cross bands and are then suspended parallel to each other in a pre-tensioned manner in a wire frame by using yet another component to clip the members to the cross bands. The pre-tensioning as well as the separation between spring member and support member increases not only the overall height of the spring base. As the individual springs are not suspended together, not even in a row, displacements are produced which allow individual springs to be felt when sat upon. This effect is increased even more through the pre-tensioning of the spring members required in this case. Individual shaping of spring members is also known in DE 100 23 466 A1.

DE 24 00 992 A1 and DE 24 00 993 A1 show an upholstery made of inextensible material which receives its resilience via spring bridge portions. This consequently produces a deflection property in the surface, as because the individual members are not extensible, the desired point deflection is not produced. The narrowly spaced disposition restricts the deformability of the upholstery.

DE 650 903 C makes known a tension-loaded spring base with flat spring members. The tension-loaded spring members produce an uncomfortable, hard impression as they prevent the load being accommodated point-by-point in a resilient manner. In addition, there is no flat structure, which means that an additional framework is necessary.

Spring suspension members are also sometimes formed by the upholstery of seats, beds or the like, and have the job of making the user feel he is sitting on a soft surface (DD 20471). They can also be cushioned at the same time with spring members, as in WO 93/03652 A or DE 198 28 254 C2. A low, space-saving overall height is not possible due to the plurality of component members. However, if the construction of the spring member, as in FR 10 74 160 A or FR 12 68 632 A, is taken into three dimensions, the individual loops of this plastics material spring member are not springy on an individual basis which means that additional cushioning has to be provided by means of a framework.

A use of a spring suspension mat on a vehicle seat is known in DE 199 02 464 A1, where a plurality of flat supporting regions is provided which are connected, where required, to webs provided with springs. The entire structure has to be tensioned in a framework. A similar construction is known in FR 27 59 649 A1 and DE 883 678 C. Springing is only possible in a surface manner, which means that it is also impossible to avoid tensile stress in the lower region. Consequently, the impression of sitting on something soft cannot be guaranteed as no spring means are provided transversely relative to the surface and no spring means are effective in a point-by-point manner. (Cf. also DE 19 16 968 U, for which there are no longer any illustrations; EP 388 542 A1).

A three-dimensional spring suspension mat is known in GB 1,042,112, where the mat is produced in one piece from plastics material. This mat cannot be adapted to arbitrary contours due the holohedral connection. In addition, the spring members are not individually deformable. In GB 2 055 173 A, contrary to this, in spite of a three-dimensional construction, there is no flexibility transversely relative to the spring member, as this spring suspension mat has wide, flat spring members. (Cf. also AT 405 481 B, DE 195 05 028 A1 and DE 92 00 114 U).

In the field of beds, the disposition of spring members situated perpendicularly relative to the lying surface is known in mattresses and bed bases (GB 614,272 and FR 15 80 446 A). Likewise DE 20 46 445 A also makes known disposing individual spring poles adjacent each other but only interconnecting them at the edge of the base. This leads to additional degrees of freedom and to bending under load, which means that the desired effect of a soft flat impression disappears. Solutions which are high in construction with at least resilient spring members which are not point by point are known in this field, for example, DE 79 29 543 U, DE 846 158 C, EP 972 470 A1, FR 955 776 A, WO 96/39906 A, DE 132 171 C, DE 132 558 C, DE 19 75 358 U, DE 20 15 659 C, DE 344 247 C, DE 357 703 C, DE 475 144 C, GB 614 133 C, GB 917 563 C, GB 934 658 C, WO 00/11989 A.

SUMMARY OF THE INVENTION

Proceeding from this state of the art, it is the object of the present invention to create the desired impression, in an alternative manner, of sitting on something soft and saving space in so doing.

An exemplary embodiment of a spring assembly includes a plurality of spring legs arranged in pairs, a bridge member extending between each spring leg of a pair of the spring legs, and a connecting member disposed between adjacent spring leg pairs to connect adjacent pairs. The spring legs, bridge member and connecting member are formed of a one-piece, continuous material, the material having a plurality of bends formed therein. The bends allow the spring leg pairs to fold independently of each other when the bridge member is subjected to a force.

In another exemplary embodiment, the spring leg pairs, the bridge member and the connecting member form a one-piece strip of continuous material.

In another exemplary embodiment, the spring assembly includes a plurality of spring legs arranged in pairs, a bridge member extending between each spring leg of a pair of the spring legs, and a connecting member disposed between adjacent spring leg pairs to connect adjacent pairs. A plurality of bends are formed between the spring legs, the bridge member and the connecting member. The bends all allow the spring leg pairs to fold independently of each other when the bridge member is subjected to a force.

In another exemplary embodiment, metal spring-steel cross bands are preferably disposed adjacent each other and are interconnected transversely relative thereto by means of cross-struts or flat joining member. This creates a construction, which is more flexible in the surface itself, is consequently also three-dimensionally deformable, and is formable into almost arbitrary three-dimensional contours. Through the transverse connections of the exemplary embodiment, the spring assembly is a unit, which can be used in construction and can nevertheless be adapted to any arbitrary fixed base support. A separate holding or tensioning frame may not be necessary.

In another exemplary embodiment, the spring assembly is used on a fixed base support. This fixed base support, such as, for example, a seat shell or the like, acts as the substructure for the spring suspension mat, which in contrast can still nevertheless be springy in the smallest space on account of its point resilience like the upholstering known up to now.

Further advantages are produced from the sub claims.

BRIEF DESCRIPTION OF THE FIGURES

The invention is described in more detail below by way of the enclosed Figures. In which:

FIG. 4 is a cross-sectional view of a of another exemplary embodiment of a spring assembly according to the invention;

FIG. 5 is a cross-sectional view of another exemplary embodiment of a spring assembly according to the invention;

FIG. 6 is a top view thereof;

FIG. 7 is a perspective view thereof;

DETAILED DESCRIPTION OF PREFERRED EMBODIMENTS

The invention will now be explained in more detail by way of example with reference to the attached drawings. However, the practical examples are only examples, which should not restrict the inventive concept to a specific arrangement.

Figure 1:
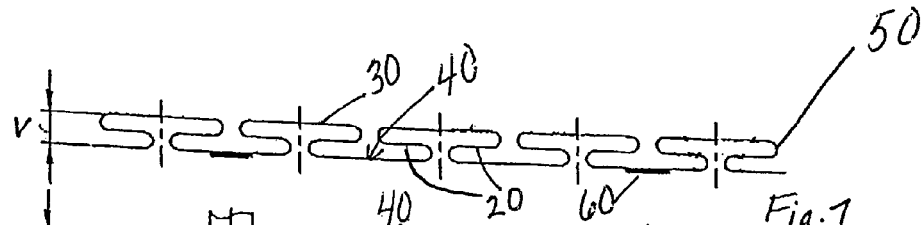
FIG. 1 is a cross-sectional view of an exemplary embodiment of a spring assembly according to the invention.
Figure 2:
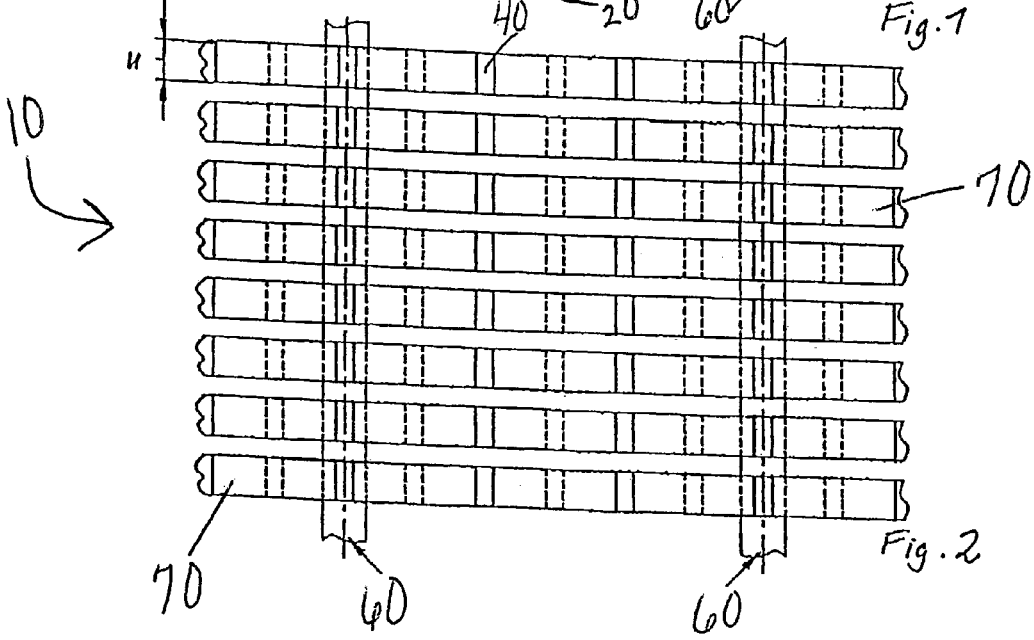
FIG. 2 is a top view thereof.

FIGS. 1 and 2 are a cross-sectional and a top view of an exemplary embodiment of a spring assembly 10, as is more especially used in a spring suspension mat for the cushioning of seats, preferably automobile vehicle seats. The use of the spring suspension mat is not restricted, however, to seating surfaces and back rests of all kinds of chairs such as office chairs, seats, sofas or automobile and airplane seats, but can for example also be used for beds or bicycle saddles. In principle, the cushioning mat is suitable for all types of use where resilient cushioning of surfaces, free of pressure points, is required.

In the case of this spring assembly 10, connecting members 40 are disposed adjacent each other and are interconnected for operative connection transversely relative to their longitudinal extension, that is relative to the first direction. The first direction extends parallel to a surface of the chair, bed or the like, which is usable by a user. The connecting members 40 have spring legs 20, which are slightly raised transversely relative to the usable surface. The spring assembly 10 also includes a bridge member 30 extending between each of a pair of spring legs 20. In exemplary embodiments, the spring legs 20 and the bridge member 30 are, portions of the connecting members 40, and are generally and continuously formed from the latter. In alternative embodiments, the spring assembly 10 may include the spring legs 20 and the bridge member 30 not being portions of the connecting members. For example, the spring legs 20, the bridge members 30 and the connecting members 40 may be formed separately and joined together to form the spring assembly 10.

Nevertheless the spring legs 20 are resiliently—so-called point resiliently—deformable, where required, individually, independent of each other. The spring legs 20 are also deformable, where required, relative to the connecting member 40. This deformability is facilitated by the spring legs 20 not being pre-tensioned in the initial condition of the spring assembly 10. The connecting members 40 are interconnected for operative connection transversely relative to their first direction via a joining member 60 substantially parallel relative to the surface. Connecting members 40 and joining member 60 can themselves be configured in a space saving manner consequently with no additional auxiliary means, which, on the one hand, makes three-dimensional constructability possible, but, on the other hand, makes a separate installation frame or tensioning frame superfluous. The spring assembly is preferably used on a fixed base such as, for example, a shell which corresponds to a desired shape. The disposition of the spring legs 20, nevertheless, giving the user the impression of conventional upholstery.

The connecting members 40 are preferably metal and consequently not difficult to recycle at a later date. More especially in the case of a metal embodiment, the spring assembly—on account of the top material—is in all cases flame-resistant and not combustible, which is particularly significant in the construction of automobile vehicles and airplanes. In alternative embodiments, other materials may also be used as long as the desired resilient characteristics are achieved. In principle, the connecting members 40 can be disposed adjacent each other in an arbitrary manner as long as it is simply guaranteed that a suitable force transference to achieve the desired spring comfort, that is to say the impression of sifting on something soft on the seat, is guaranteed. The connecting members 40 are preferably disposed substantially parallel to each other, as can be seen in FIG. 2. In the exemplified embodiment, the spring legs 20 protrude upwards from the connecting members 40; a reversed installation where the spring legs 20, protrude downwards from the connecting members 40 is also equally possible.

A spring suspension mat of this type will be a flat construction for the most part, which is also deformable, however, in the third dimension, where necessary, on account of the transverse connection by means of the joining member 60. For example, in exemplary embodiments, it is adaptable to the contour of a seat. If, however, a three-dimensional spring resilient member is desired, the mat can also extend in the third dimension. In this case, a connection between various connecting members 40 can also be effected in the third dimension. Through the transverse connections, the spring assembly is a constructible unit, which nevertheless adapts to any arbitrary fixed base.

FIG. 2 shows an exemplary embodiment of a spring assembly including connecting members 40 made from spring-steel cross bands with a width 'u'. To achieve a better spring effect, the spring-steel cross band is bent upward to a height 'v' in a loop-shaped manner. In alternative embodiments, the height 'v' of the spring assembly may be reduced down to 10 mm below or less mounting height without loss of the sitting-down or lying-down feeling striven for, which results in a construction which is extremely space and also weight saving, as the spring assembly is also the seating surface. Nevertheless there is good springiness precisely on account of the capability of the spring legs 20 to fold at a plurality of bends 50. The overall height of the spring assembly corresponds namely almost to the spring excursion of the spring legs 20. The individual spring legs 20 give way in a point resilient manner, where necessary, up to the reduction to their material strength without any plastic deforming occurring. In alternative embodiments, arbitrary overall heights are possible, however overall heights between 8 and 20 mm, preferably 10 mm are possible. This construction type consequently also results in an additional support, more especially where it is used in an automobile vehicle, as lateral movements are possible only over the overall height, which is an advantage compared to conventional upholstery.

Figure 3:
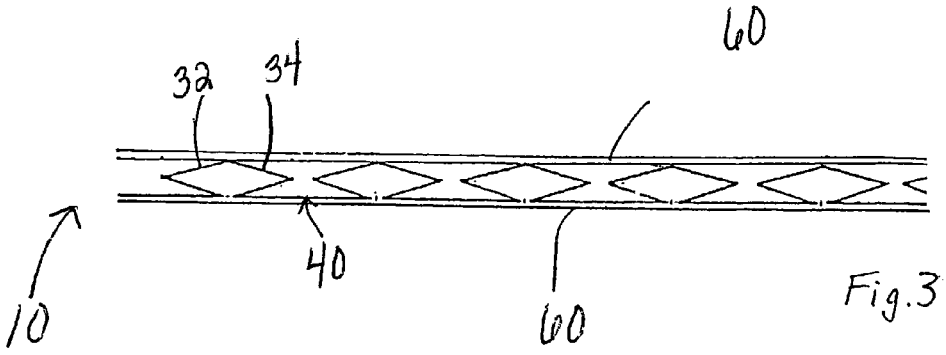
FIG. 3 is a cross-sectional view of another exemplary embodiment of a spring assembly according to the invention.

To achieve an operative connection, these connecting members 40 can be interconnected by means of a flat joining member 60 (FIG. 3). In exemplary embodiments, the joining member 60 may be glued to the connecting members 40. In alternative embodiments, the joining member 60 may also be attached to bridge members 30. The joining member 60 may be disposed on one side or on both sides of the spring assembly 10 with the connecting members 40. In principle, for example, a central joining member 60 can also be in operative connection with connecting members 40 on one or both sides. The joining member 60 may, for example, be in the form of a mesh, a layer, a mat or a film. In these cases too, a three-dimensional structure can be achieved by means of disposing connecting members 40 and joining member 60 in a corresponding manner.

In an alternative thereto or in addition thereto, the connecting members 40 are in the form of resilient transverse struts, as is shown in the exemplary embodiment of FIGS. 2 and 6. This connecting through strut-like connecting members 40 is more especially suitable where spring-steel cross bands are used as the connecting member 40. Compared to previously known spring assemblies, this connection facilitates a three-dimensional formability of the spring assembly 10. In principle, it is possible to develop the spring conditions as being variously hard or soft by using different material strengths over the seating surface. In other words, various spring-steel cross bands can be used adjacent each other. This means that a specific springiness can also be achieved in a targeted manner internally of or within the surface.

The spring-steel cross band in FIG. 1 has a different bending radius of the bends 50 than the bends 50 of the spring-steel cross band in FIG. 4. This can also influence the resilience of the spring suspension mat. However, the smaller the bending radius, the better the respective bends 50 can fold inwards. The bends 50 may be configured in a variety of configurations, including but not limited to a loop, diamond or the like. In alternative embodiments, the bends 50 of the spring assembly 10 may include the same bending radius or the bends 50 may include different bending radii.

If a small bending radius is selected, as, for example, in FIG. 4, the bent members can be compressed with a resilient deforming as far as almost zero, more concisely put as far as approximately the material strength of the spring legs 20 in the direction of load transversely relative to the usable surface—in an exemplified embodiment three times the material strength of the spring legs 20. However, as this occurs for each bend independently and in a varyingly strong manner depending on the load, this leads to the impression of sitting on something soft and free of pressure. Each configuration of spring legs 20, bridge member 30 and connecting member 40 includes at least four bends 50. In the exemplified embodiments in FIGS. 4 to 10, five bends 50 are shown, of which at least four of the bends 50 are configured with a small, acutely angled bending radius in order to achieve the "folding" of the spring legs 20. Consequently, individual spring legs 20 may be folded in these places with small bending radii, which means that, when folding on the small bending radii the material can be folded-up as far as its material strength. This leads to a large spring excursion with a small mounting height. The bending radii are designed in such a manner in this case that, nevertheless, there is no plastic deformation. This design imitates the design of a leaf spring, the external corner points 52 being pressed approximately regularly outwards under pressure with the lowering of also the upper central point 36. The compressive and tensile stresses generated at the same time in the upper and lower portions of the spring legs 20 are eliminated substantially, which means that—if at all—small transverse forces are transferred into the members situated in the base surface themselves when used on a fixed base.

Figure 8:
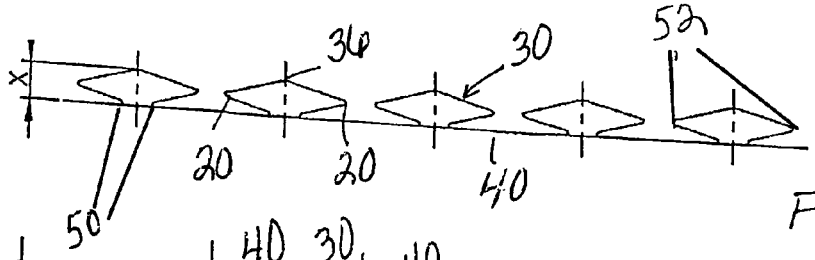
FIG. 8 is a cross-sectional view of another exemplary embodiment of a spring assembly according to the invention.
Figure 9:
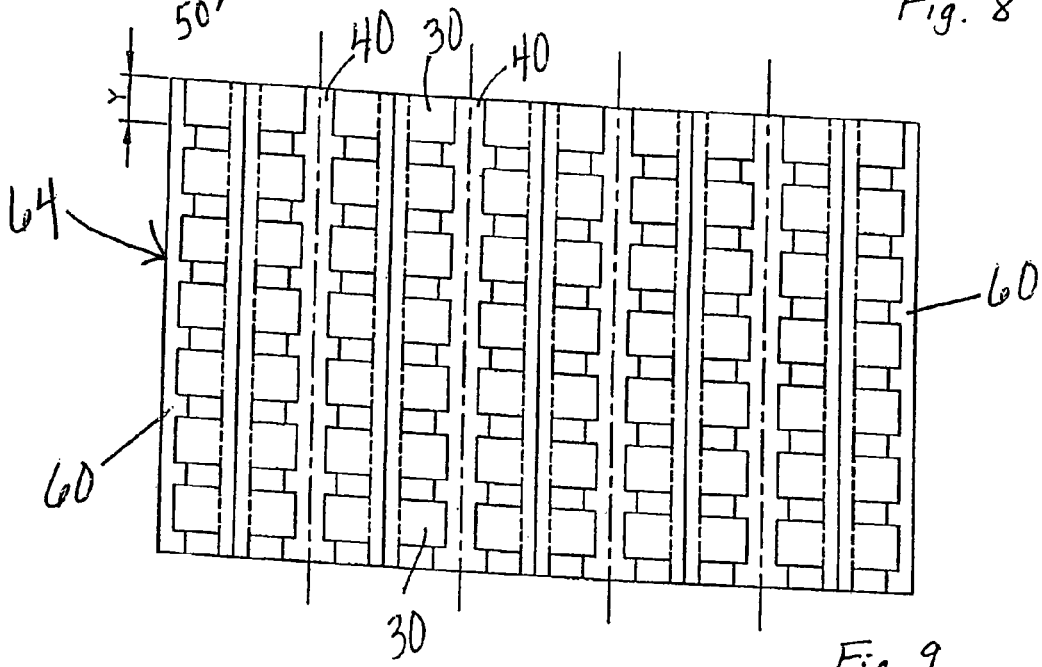
FIG. 9 is a top view thereof.
Figure 10:
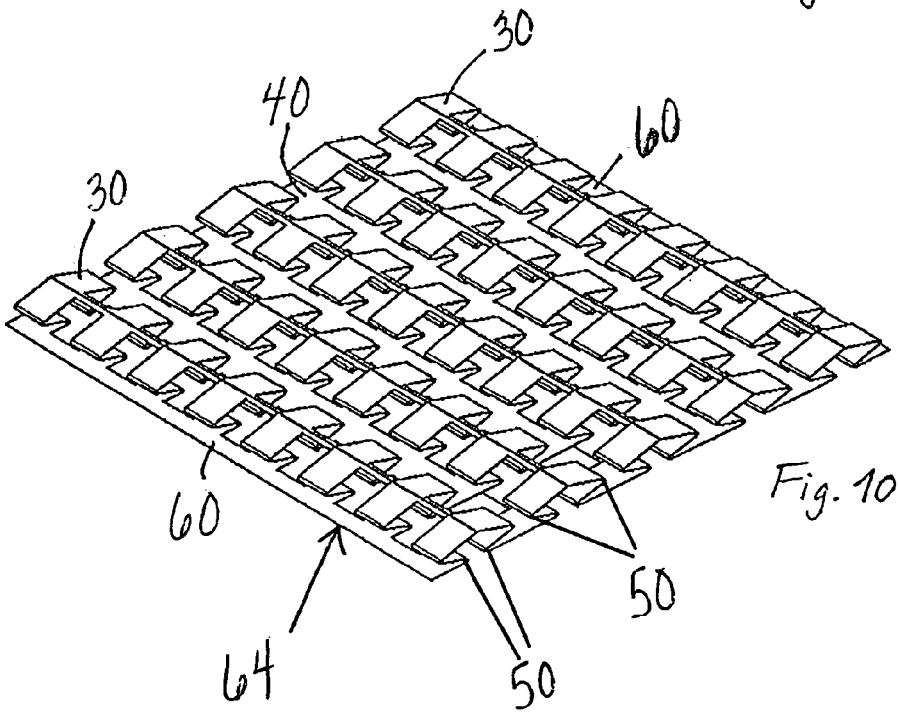
FIG. 10 is a perspective view thereof.

In the exemplified embodiments in FIGS. 1 to 7, the spring assembly 10 has several strips 70 with arbitrary widths and lengths. In place of the spring-steel cross bands, plastics materials or other resilient materials can be used, albeit preference is given to the metal spring member. The individual strips 70 can be connected to the joining member 60, in the most varied of manners. A hollow rivet or a laser weld, for example, can be used for the connection between the connecting members 40 and the joining members 60. However, the connecting members 40 can also be assembled, for example, as a plastics material injection molded part. Another exemplary embodiment is represented in FIGS. 8 to 10. The connecting members 40 rise out of a base surface 64. A corresponding part can be injection molded or can also be deep drawn from a plastics material part—or also a metal part—by way of plastic deformation.

In both cases, a holohedral sitting feeling with no noticeable pressure points, unlike previously known connecting members or spring suspension mattresses, can be achieved by means of the tightly adjacent, high number of contact points in the direction of the surface "to be sat upon".

Following assembly from individual members, the spring assembly is suitable under load for any body shape, comparable to a water bed.

In alternative embodiments, the spring assembly 10, comprising the connecting members 40 and the joining members 60, may be constructed as a composite material which is used in seats, more especially in vehicle seats. This composite material can in its turn include parts of the vehicle seat such as the upholstery. The composite material can also be an integral component part of the vehicle seat or of parts of the vehicle seat.

Figure 11:
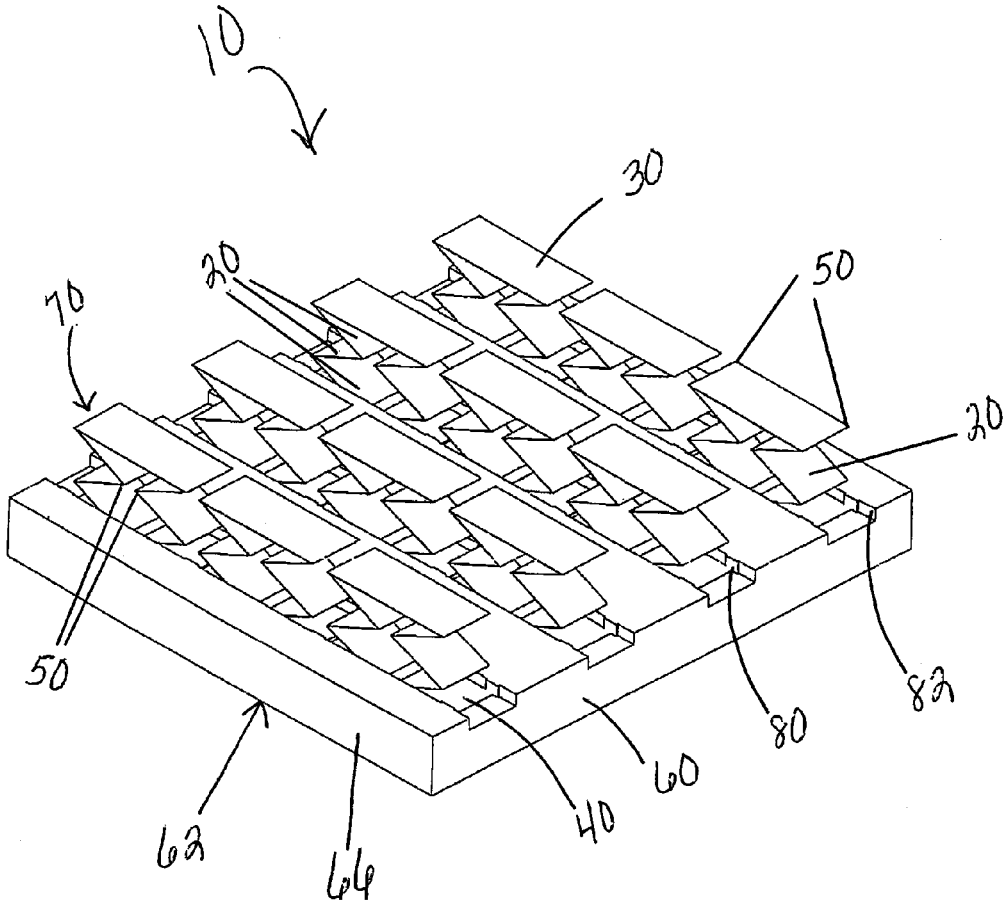
FIG. 11 is a perspective view of another exemplary embodiment of a spring assembly according to the invention.
Figure 12:
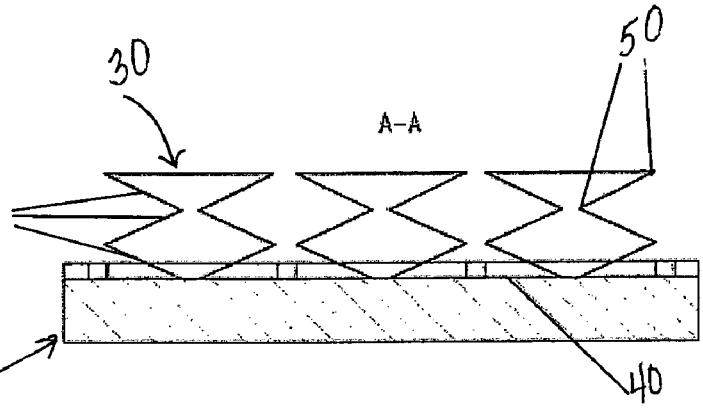
FIG. 12 is a cross-sectional view thereof.
Figure 13:
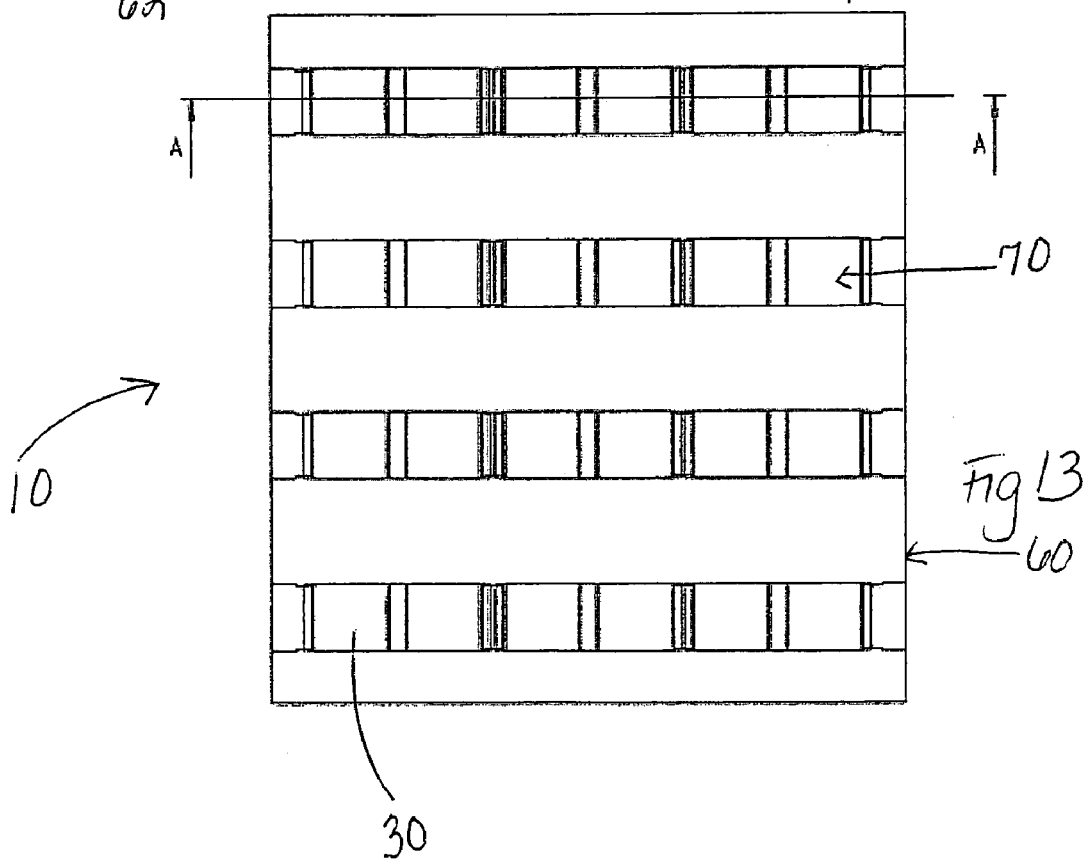
FIG. 13 shows a top thereof.

FIGS. 11-13 show another exemplary embodiment of a spring assembly 10 in a perspective, a cross-sectional and a top view, respectively. The connecting members 40 are part of a carrier 62, the carrier 62 being essentially a joining member 60 for operative connection of the connecting members 40. The seat carrier 62 includes transverse element 60 and longitudinal element 66, the transverse element 60 transversely connecting the connecting members 40. In alternative embodiments, it is also possible to use a shell instead of the seat carrier such that the shell can be fixed on the seat carrier of a vehicle.

Additionally, the spring legs 20 of FIGS. 11-13 are distinguished from the diamond shape of the spring legs 20 described hereinbefore. The spring legs 20 comprise several legs 20 on both sides of the bridge member 30. The spring legs 20 connect to a connecting member 40 which is generally parallel to the bridge member 30. The spring legs 20 are connected to each other, to the corresponding bridge member 30 and to the corresponding connecting member 30 by bends 50. The bends 50 include a small bending radius. As discussed above, the small bending radius of the bends 50 allow the spring legs 20 to fold when a generally transverse load is applied to the bridging member 30. In alternative embodiments other angles are possible as long as such angles allow the spring legs to be folded down as far as possible, preferably down to their material strength.

As can be seen from FIG. 11, the spring legs 20 are arranged below the bridging portion 30. In the top view of FIG. 13, the spring legs 20 are covered by the bridging portion 30. In alternative embodiments, when the spring legs 20 are in a folded or unfolded condition, the legs may protrude from the ends of the bridging portion 30.

In the exemplary embodiment of FIGS. 11-13, the connecting member 30 is shown continuously formed with spring legs 20 and the bridge member 30. The one-piece construction of the connecting member 30, spring legs 20, and bridge member 30 form the spring strip 70.

As shown in FIG. 11, seat carrier 62 comprises longitudinally extending grooves 82 adapted to receive the connecting members 40. The connecting members 40 are snapped or clipped into the grooves 82. Thus the spring assembly 10 is formed by securing the connecting members 40 into the grooves 82 in the surface of the seat carrier 62.

Noses 80 are provided on opposing sides of the grooves 82 to secure the connecting members 40 in the grooves 82. The noses 80, as shown in FIG. 13, are provided in the area corresponding to the longitudinal bottom connection of the spring strip 70, arranged between adjacent connecting members 40. The spring assembly is produced in all sizes and shapes, including, but not limited to, rectangular, square, oval, round, triangular and so on. The assembly can be produced with defined sinking depths and hardness at arbitrary points, as for this purpose only a corresponding selection of connecting members 40 or their shape for these points or respectively at these points is necessary. The assembly is very flexible and is suitable for all possible basic shapes depending on the area of application. To this end, the mat does not have to be additionally plastically deformed, for example through angling, bending or the same. The mat follows an arbitrary basic outline. Additional supports and/or shaped frameworks can be used, but they are not absolutely necessary as the spring suspension mat, where necessary, can be reinforced in itself and nevertheless still offers the desired spring comfort through the spring legs 20. The spring assembly is preferably used on an arbitrary fixed base, such as, for example, a shell, perforated where necessary. On account of its design, it can be adapted to the contour, but due to the point resilience allows a springiness as with previously known upholsteries. For the same reason, the spring suspension mat does not lose its outer shape under compressive load as the pressure is absorbed by the fashioning of the individual connecting members.

It is obvious that this description can be subject to the most varying modifications, changes and adaptations, which vary in the region of equivalents to the attached claims.

The invention claimed is:

1. A spring assembly for a suspension mat, the spring assembly comprising:

a plurality of spring assembly units, each of said spring assembly units including a pair of spring legs and a bridge member extending between each spring leg of said pair of said spring legs; and a connecting member disposed between adjacent spring assembly units of said plurality of spring assembly units so as to connect said adjacent spring assembly units;

wherein said spring leg pairs, said bridge members and said connecting members are non-releasably connected with each other and formed of a one-piece, continuous material, and wherein each of said spring assembly units includes at least three substantially angular bends formed therein;

wherein said bends allow the spring leg pairs to fold independently of each other when said bridge member is subject to a force.

2. A spring assembly of claim 1, wherein said spring leg pairs, said bridge member and said connecting member form a one-piece strip of said continuous material.

3. The spring assembly of claim 1, wherein said spring assembly units include four bends.

4. The spring assembly of claim 1, wherein at least one of said bends comprise an acute angle less than 45 degrees.

5. The spring assembly of claim 1, wherein connecting members are disposed substantially parallel to each other.

6. The spring assembly of claim 1, wherein connecting members include spring-steel cross bands.

7. The spring assembly of claim 1, further comprising a joining member disposed between a plurality of connecting members.

8. The spring assembly of claim 1, further comprising a joining member disposed between a plurality of bridge members.

9. The spring assembly of claim 7, wherein said joining member is transverse to a direction of said spring leg pairs, said bridge member and said connecting member.

10. The spring assembly of claim 7, wherein said joining member is a flat member, said flat member including at least one of a mesh, a mat, and a film.

11. The spring assembly of claim 7, wherein said joining member is resilient.

12. The spring assembly of claim 1, wherein at least one of said spring legs, said bridge member, and said connecting members includes plastic.

13. The spring assembly of claim 1, wherein the suspension mat is disposed on a fixed support corresponding to a desired outline of a seat, bed or chair.

14. The spring assembly of claim 7, wherein said connecting member and said joining member forms a composite material for use in seats or vehicle seats.

15. The spring assembly of claim 14, wherein the composite material includes further parts of a vehicle seat and/or is an integral component part of the vehicle seat or parts thereof.

16. The spring assembly of claim 1, wherein connecting members and said spring legs are situated so closely adjacent each other that a flat impression is produced through the number of support points.

17. The spring assembly of claim 1, wherein overall height of the spring suspension mat is between 8 and 20 mm.

18. The spring assembly of claim 1, wherein overall height of the spring suspension mat is 10 mm.

19. Vehicle seat with a spring assembly according to claim 1.

20. A spring assembly for a suspension mat, the spring assembly comprising:

a plurality of spring assembly units, each of said spring assembly units including a pair of spring legs and a bridge member extending between each spring leg of said pair of said spring legs; and a connecting member disposed between adjacent spring assembly units of said plurality of spring assembly units so as to connect said adjacent spring assembly units;

wherein said spring leg pairs, said bridge members and said connecting members are non-releasably connected with each other and formed of a one-piece, continuous material, and wherein each of said spring assembly units includes at least five substantially angular bends formed therein;

wherein said bends allow the spring leg pairs to fold independently of each other when said bridge member is subject to a force.

* * * * *